US005477900A

United States Patent [19]

Gray

[11] Patent Number: 5,477,900

[45] Date of Patent: Dec. 26, 1995

[54] NON-JAMMING PULPWOOD CHIPPER CHUTE AND SPOUT ASSEMBLY

[76] Inventor: David A. Gray, 2325 Lowndes Rd., Columbia, S.C. 29205

[21] Appl. No.: 404,417

[22] Filed: Mar. 15, 1995

[51] Int. Cl.[6] ..... B27C 1/00

[52] U.S. Cl. ..... 144/180; 144/162 R; 144/176; 144/356; 241/34; 209/245

[58] Field of Search ..... 144/162 R, 176, 144/180, 242 R, 356; 241/34, 92, 98, 278.1; 209/243, 244, 245

[56] References Cited

U.S. PATENT DOCUMENTS

| | | | |
|---|---|---|---|
| 2,582,537 | 1/1952 | Flaleboe | 144/180 UX |
| 2,837,290 | 6/1958 | Nagel | 241/185 |
| 3,703,970 | 11/1972 | Benson | 241/241 |
| 3,819,121 | 6/1974 | Rogers | 241/240 |
| 4,088,273 | 5/1978 | Jakobs | 241/35 |
| 4,134,554 | 1/1979 | Morlock | 241/35 |
| 4,140,282 | 2/1979 | Steimel | 241/36 |
| 4,398,674 | 8/1983 | Dremann | 241/30 |
| 4,449,671 | 5/1984 | Martinez-Veraeta | 241/36 |
| 4,690,337 | 9/1987 | Stiefel | 241/36 |
| 4,917,310 | 4/1990 | Carrera | 241/32 |
| 5,248,100 | 9/1993 | Arakawa | 241/34 |

*Primary Examiner*—W. Donald Bray
*Attorney, Agent, or Firm*—Michael A. Mann

[57] ABSTRACT

An improved chute and spout assembly for use with a wood chipper that clears logjams by the use of hydraulic rams attached to the chute near the chipper. The rams move between an extended position, for moving the logs, and a retracted position, when the logs are sliding by gravity on the interior surface of the chute. The rams are oriented and spaced apart in order to move the logs when jammed without interfering with each other when more than one ram is extended into the interior of the chute to move the logs. When retracted, the ends of the rams are approximately flush with the interior surface of the chute. Each ram is independently controlled for flexibility in clearing logjams.

19 Claims, 3 Drawing Sheets

10
14
30
26
18
54
41
28
12
44
54
20
24
22
38

10
18
14
12
54
16
20
22

12
46
35
18
37
40
62
50
54
41
42
44
34C
34B
34A 12
28
28
28
34

10
116
18
12
118
34
28
54
34
20
34
14
16

40
12
34

10
14
18
18
34
28
34
114
34
20
34
112
34
110

NON-JAMMING PULPWOOD CHIPPER CHUTE AND SPOUT ASSEMBLY

BACKGROUND OF THE INVENTION

1. Field of the Invention

The present invention relates to pulpwood chippers, and more particularly, to the chute and spout assembly of a pulpwood chipper.

2. Discussion of Background

In the manufacturing of paper, debarked logs of pulpwood are fed into chippers which break down the log into small wood chips. In the past, large, uniformly-sized logs were fed into such chippers one log at a time. There was thus no concern about one log interfering with another to the point where it would jam the chute and spout assembly leading to the chipper, and thereby prevent advance of the logs.

Paper pulp demand, however, has resulted in increased loads being fed into wood chippers. It is now common practice to feed many different-sized, irregular logs into a wood chipper simultaneously, including logs from three (3) inches to eight (8) inches in diameter. These logs tend to become misaligned as they fall toward a chipper's cutting blade and cause a logjam in the chipper's chute and spout assembly.

When the chute becomes jammed, it must be cleared for the logs to progress. The current method used to clear a chipper chute and spout assembly involves manually grasping and dislodging an interfering log from the top of the chute. Typically, the dislodging is carded out using tongs having a pair of handles and a grabbing end, or by using slings to pull the jammed logs up.

Because of the enormous amount of electrical power required to start a chipper disc, it has been a common practice to attempt to clear jammed logs without turning off the chipper's motor. In some instances, an instrument used to clear the logs may be pulled down abruptly toward the knives of a chipper disc, and effectively destroy the entire chipper knives and/or disc.

It will be appreciated that clearing jammed logs in a chipper chute by manually inserting an instrument into a chipper chute and spout assembly is inefficient and dangerous. There is, therefore, an urgent need for a better solution to the problem of wood chipper chute and spout assembly logjams.

SUMMARY OF THE INVENTION

The present invention is a pulpwood chipper chute and spout assembly having means disposed therein for clearing jammed logs. The clearing means is provided by one or more rams carried by the chute and spout assembly disposed along the assembly's length. Driven by hydraulic, pneumatic or by other well known means, the rams of the invention can penetrate on command from a safe, remote location of the operator into the interior of a chute and spout assembly among the jammed logs, to impart an upward force on interfering logs, and thus clear the logjam.

In one preferred embodiment of the invention, a single ram is installed in the bottom of the chute and spout assembly, with the ramming end of the ram shaped to conform to the bottom of the chute and spout assembly.

In another preferred embodiment of the invention, a chipper chute and spout assembly has disposed thereon, at a distance from a chipper blade that depends on the length of logs to be fed into the chipper, a set of rams that can extend into a chute and spout assembly. The rams are mounted perpendicular to the assembly's inclined walls so that the rams point upwardly with respect to the horizontal plane. The rams extend at least about halfway through the chute or spout where they are installed, and are slightly offset so that they do not contact each other when both are in a fully extended position.

In another preferred embodiment, a plurality of sets of rams are arranged along the length of a chute and spout assembly so that the chute and spout assembly can most efficiently provide clearing of logjams for many different-length logs.

In still another embodiment of the invention, a closed chute and spout assembly is provided and a plurality of rams are installed about the circumference of a cross section of the assembly.

An important feature of the present invention is the deployment of the rams at a position that depends on the length of logs to be chipped. This feature enables their use where the jam is most likely to occur and at the point where upward extension of one or more rams can have the most beneficial effect on the logjam.

Another important feature of the invention is the use of multiple rams deployed at an angle with respect to each other. The use of multiple rams enables an additional degree of flexibility in clearing logjams.

Still another feature of the present invention is the positioning of the rams to operate perpendicular to the nominal plane of the chute. In this position, their point of extension into the interior of the chute is less likely to become an obstacle to logs sliding down the chute, but it still enables the rams to impart an upward force component to the logs because the chutes are inclined at an acute angle with respect to the horizontal. The rams essentially "fluff" the logs to clear them.

Other features and advantages will become apparent to those skilled in the art of chipping logs from a careful reading of the Detailed Description of Preferred Embodiment accompanied by the following drawings.

DETAILED DESCRIPTION OF PREFERRED EMBODIMENTS

Figure 1:
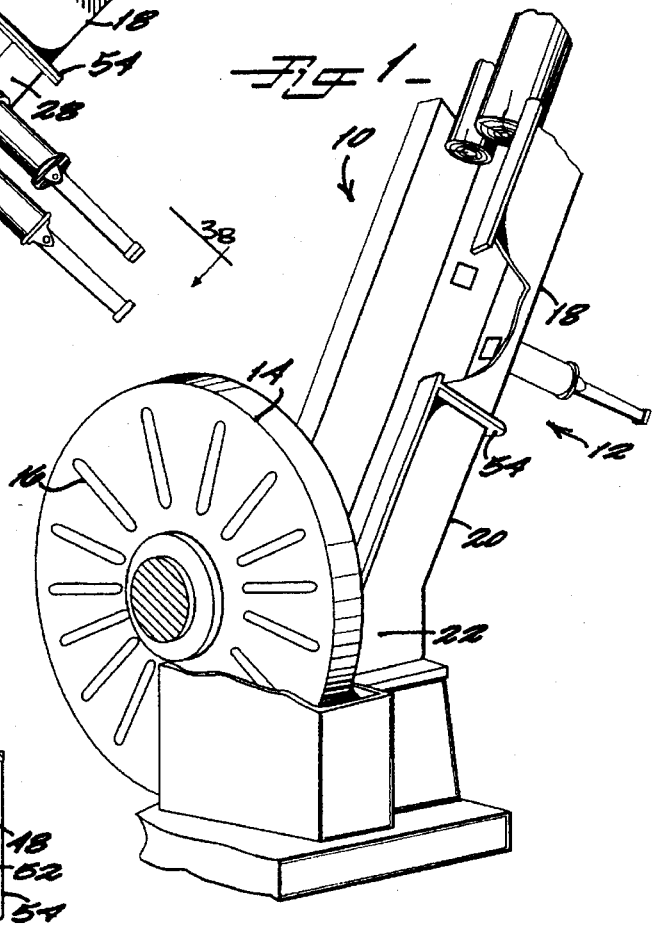
FIG. 1 is a perspective view of a wood chipper having a chute and spout assembly in accordance with an embodiment of the invention.

Referring to the drawings, FIG. 1 shows a typical pulpwood chipper having a chute and spout assembly which is improved in accordance with the invention. As shown, a pulpwood chipper 10 includes rotating cutting disc 14 and a chute and spout assembly 12. Driven by a motor (not shown), cutting disc 14 is typically about ten feet in diameter and comprises a plurality of knives 16. Shown generally at 12, chute and spout assembly comprises a chute 18, and a spout 20, which guide logs toward cutting disc 14. Formed at the bottom end 22 of spout 20 is a stationary blade 24 which cooperates with knives 16 of cutting disc 14 to cut small wood pieces, ("chips") from logs. Situated proximate with chute 18 is conveyor 26 (see FIG. 3*a*), which transports logs from a remote location and feeds them onto chute 18.

In use, logs are transported by conveyer 26 until they reach chute 18, whereupon they begin to slide down, under the force of gravity, over chute 18, then over spout 20, toward cutting disc 14. When a log end reaches cutting disc 14, a knife 16 contacts a log and begins to cut. By the time a first knife blade penetrates a few inches into a log, a second knife blade contacts the log to produce a chip. Stationary blade 24 formed about the end of spout 22 shears any loose wood pieces that may become trapped between spout 20 and cutting disc 14 and thereby prevents stoppage of cutting blade 14.

So that the chipper produces chips sized properly for processing after chipping, chute and spout assembly 12 is rather precisely installed and pitched at an angle of between about 52 and about 54 degrees from a horizontal position.

The count of logs entering conveyor 26 from a debarker (not shown) is unpredictable. Sometimes a single log will be transported by the conveyor 26 to chute 18, and at other times a plurality of logs will be transported. The problem of chute and spout jamming is observed when several logs are sent toward cutting disc 14 more or less simultaneously. If one log becomes disoriented (it is no longer aligned with a chute or spout wall) then a jam can occur. In a typical jam, a group of two or more entangled logs interfere and impart forces on the opposite walls of a chute or spout. When a jam occurs, the logs do not continue to slide toward cutting disc 14. Conveyor 26 can be stopped to cut off the flow of logs toward chute 18, but cutting blade 14 is preferably not stopped in view of the enormous amount of electrical power required to restart cutting disc 14.

Chute and spout assembly 12 comprises a chute 18 and a spout 20. Additionally, as illustrated in FIGS. 2*a*, 3*a*, 5, and 6, chute and spout assembly 12 may have a transition piece 28 interposed between chute 18 and spout 20. Transition piece 28, which may be retrofitted onto a chute and spout assembly by cutting away a portion of a chipper's chute 18, improves the accessibility of spout 20. Spout 20 is often removed and reinstalled for maintenance purposes.

Figure 2A:
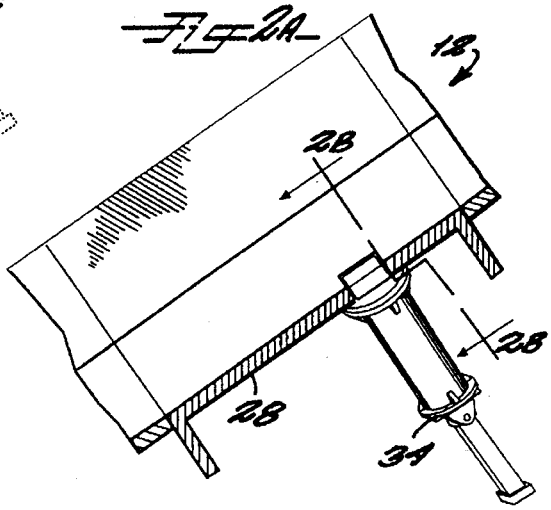
FIG. 2*a* is a side view of a single-ram embodiment of the present invention.
Figure 2B:
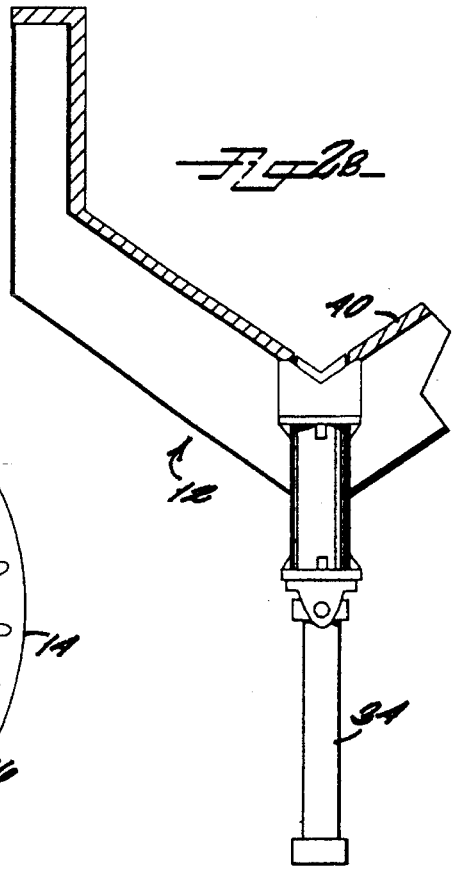
FIG. 2*b* is a cross-sectional view taken along line b—b of FIG. 2*a*.

Referring now to FIGS. 2*a* and 2*b*, an embodiment of the invention may be made by installing a single ram 34 in the walls of chute and spout assembly 12 such that ram 34 retrievably y extends into the interior of the chute and spout assembly 12. Ram 34 may be installed anywhere along the length of chute and spout assembly 12. Preferably, ram 34 is installed to project at least slightly upwardly with respect to the horizontal plane. Chute and spout assembly 12 has a substantially constant width throughout its length and is not conical or otherwise funnel-shaped.

If one ram is installed in chute and spout assembly 12, ram 34 is preferably installed at the chute and spout assembly's bottom, as illustrated in FIGS. 2*a* and 2*b*. Since most chute and spout assemblies are made to have v-shaped bottoms, such an embodiment may be realized by shaping ramming end 35 of ram 34 such that it conforms to the shape bottom of chute and spout assembly 12, as illustrated in FIG. 2*b*.

It will be recognized that the particular shapes of the ramming end 35 and the interior surface 40 of chute and spout assembly 12 are not critical. The major concern is that, when it is in a fully retracted position, no part of ram 34 should extend outwardly beyond the interior surface 72 of the chute and spout assembly 12; otherwise ram 34 may disturb the smooth flow of logs down the assembly. Preferably, ramming end 35 of ram 34 is formed to be flush with the assembly's interior surface 40 when ram 34 is in a fully retracted position.

The preferred width of ram 34 will vary in proportion to the width of chute and spout assembly 12. If chute and spout assembly 12 has a width of 30–36 inches, the preferred width of ram 34 is between about 4 and about 6 inches and most preferably about 5 inches. The cross-section of ram 34 is preferably circular, but may be of any shape including rectangular, square, oval, star-shaped, or crescent-shaped.

Figure 3A:
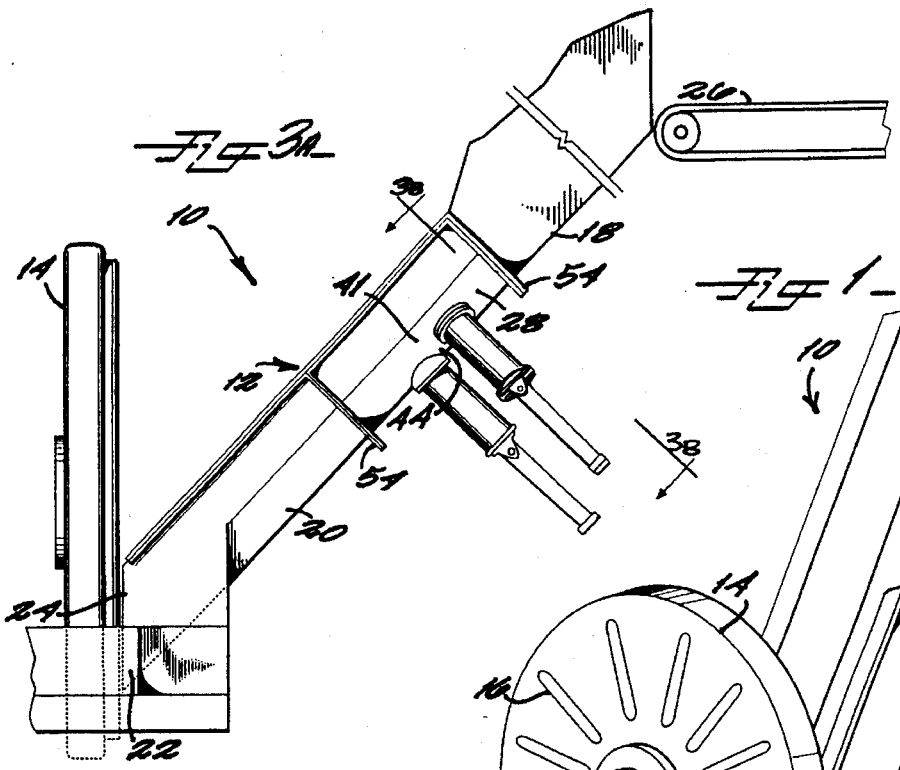
FIG. 3*a* is a side view of a dual-ram embodiment of the present invention.
Figure 3B:
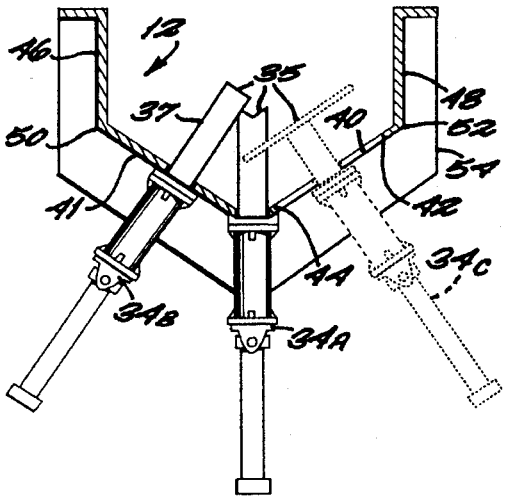
FIG. 3*b* is a cross-sectional view taken along line b—b of FIG. 3*b*.

Ramming end 35 of ram 34 may be configured to have a larger cross-sectional area than ram body 37. A ram 34 may have an enlarged ramming end 35, as illustrated by phantom ram 34*c* of FIG. 3*b*. Enlarged ramming end 35 of ram 34*c*, as is the case with all rams, should be formed to be flush with interior surface 36 of chute and spout assembly. An enlarged ramming end may be formed to extend the width of a surface of assembly 12, such as bottom surface 42. An enlarged ramming end may also be formed extend the entire width of assembly 12; for example an enlarged ramming end may be formed to extend from first sidewall 46 to second sidewall 48 of an assembly configured as shown in FIG. 3*b*.

An embodiment of the present invention may have more than one ram. Shown in FIGS. 3*a* and 3*b* is an embodiment of the invention having a pair of cooperating rams installed in a v-shaped chute and spout assembly 12. A V-shaped chute and spout assembly has a first pitched bottom surface 41 second pitched bottom surface 42 which meet at bottom 44. Sidewalls 46 and 48 extend upwardly from outside edges 50 and 52 of pitched surfaces 40 and 42. A sidewall 46 in combination with a pitched bottom surface 40 forms a "wall" of a v-shaped chute mad spout assembly 12. Flanges 54 provide support for the chute and spout assembly 12, and include means which enable the sections of the assembly to be fastened together.

First ram 34*a* is installed at the chute bottom 44 as in the single ram embodiment described previously. Second ram 34*b* is installed in first pitched bottom surface 41 generally perpendicular to a pitched bottom surface 41. Rams 34*a* and 34*b* extend into the interior of chute and spout assembly 12. The distance to which rams 34*a* and 34*b* extend should vary depending on the width of assembly 12 and the angle and position at which rams 34*a* and 34*b* are installed. Preferably, second ram 34*b* is designed to extend at least to the middle plane of assembly as defined by dotted line m of FIG. 3*b*. Fully extended, first ram 34*a* and second ram 34*b* preferably do not contact each other; rather they should be offset so that fully extended rams bypass each other. Bypassing of the rams can be accomplished by installing a first ram at a slightly higher elevation along the length of chute and spout assembly than a second ram.

When a logjam is observed, preferably by remote circuit television, an operator will stop conveyor 26 to stop the flow of logs, and then typically will operate a first ram to exert an upward force against an interfering log. If this action is not successful in clearing the logjam, a second ram 34*b* will be extended to exert an upward force on a log in the assembly from a different angle, and so on. If the logjam is still not cleared, the operator can activate a plurality of rams simultaneously, so as to impart an upward force on an interfering log or cluster of logs from different sides of the log or cluster simultaneously.

A third ram may be installed on the second bottom surface 42 as illustrated by phantom ram 34*c* of FIG. 3*b*. A plurality of additional rams may be installed throughout the walls of assembly 12, possibly at various distances from cutting blade 14. An alternative two-ram embodiment of the invention may be realized by installing a ram at each bottom surface 41 and 42 of the chute and spout assembly 12 at the positions of ram 34*b* and phantom ram 34*c*.

When a ram 34 is installed at a flat surface of a chute and spout assembly 12, as in 34*b* and 34*c* of FIG. 3, it is preferred that the ram is installed generally perpendicular to the surface. Mounting a ram perpendicularly to the walls of the assembly is preferred only in the sense that such a ram assembly is easier to make and install than a ram assembly mounted obliquely. However, in terms of operation, there is no particular advantage to a perpendicularly mounted ram, and in certain applications an obliquely mounted ram may be preferred to a perpendicularly mounted ram in terms of performance. It is seen that the upward force component imparted by a ram is increased by installing ram 34 at a more oblique angle.

Rams which exert a force having an upward component, no matter how slight, are expected to be effective in clearing a logjam in a chute or spout; and it is expected that even a ram which is directed below the horizontal plane, although such design is not preferred, would have some utility as an instrument for clearing a logjam in a chute and spout assembly.

Figure 4:
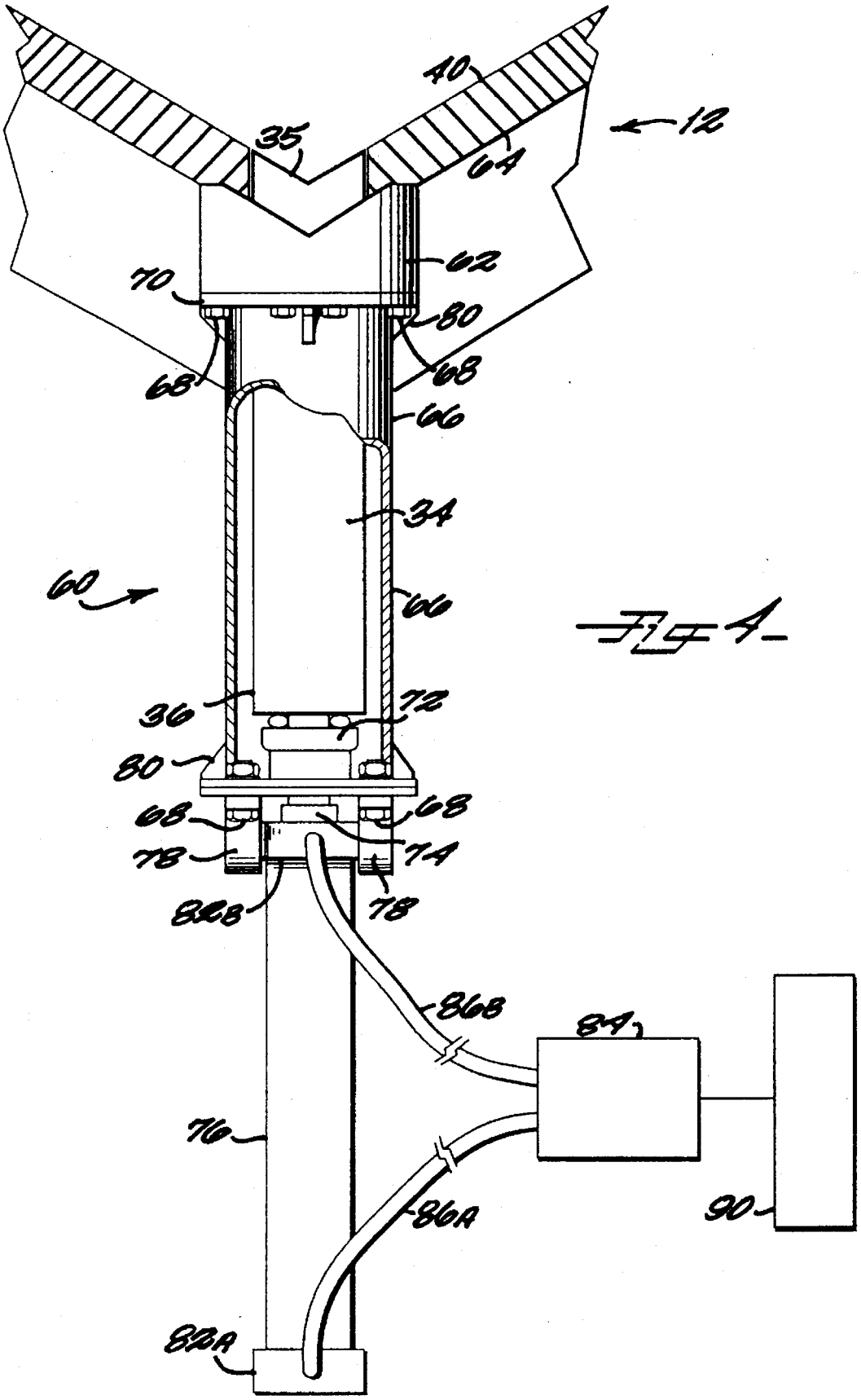
FIG. 4 is detailed view of a possible ram assembly in accordance with the invention.

Now referring to FIG. 4, a representative ram assembly of the invention will be described in detail. Ram assembly 60 includes a mounting block 62 welded to the outer surface 64 of the chute and spout assembly 12. Mounting tube 66 extends outwardly from mounting block and is affixed to mounting block 62 by means capscrews 68 driven though aligned holes formed about the periphery of flange 70 of mounting tube 66 and of mounting block 62. In a fully retracted position, ram 34 is contained within mounting tube 66. Attached to the interior end 36 of ram 34 is male rod eye 72 which is matingly received in rod clevis 74 extending from hydraulic cylinder 76. Hydraulic cylinder 76 may be supported on the assembly by means of mounting end caps 78 affixed to mounting tube 66 by capscrews 68 driven through aligned holes of the mounting end caps 78 and mounting tube 66. Gussets 80 may be employed to provide additional structural support for mounting tube 66.

To control the movement of ram 34 into and out of chute and spout assembly 12, fluid is pumped into and out of a hydraulic cylinder 76 through hydraulic connections 82*a* and 82*b*. Disposed inside cylinder 76 flush with the interior walls of cylinder 76 is a piston (not shown) connected to rod clevis 74 by way of a rod (not: shown). For extending ram 34 into the interior of chute and spout assembly 12, fluid is pumped into cylinder 76 though first hydraulic connection 82*a*. This pushes the cylinder's piston toward second connection 82*b*, and thus pushes rod clevis 74 outwardly with respect to cylinder 76, causing ram 34 to extend into the interior of chute and spout assembly 12. For retracting ram 34 from the interior of assembly 12, fluid is pumped into second hydraulic connection 82*b*. This pushes the piston toward first connection 82*a*, and the piston pulls rod clevis 74 toward cylinder 76, causing ram 34 to be retracted from the chute and spout assembly 12 interior.

Means may be employed to maintain a specific radial alignment of ram 34 within the walls of mounting tube 66. When a ram 34 is installed at the chute and spout assembly bottom 44, as in 34 of FIG. 2*b*, 34*a* of FIG. 3*b*, and 34 of FIG. 4, radial alignment of ram 34 is important, since misalignment of ram 34 would result in a portion of ramming end 35 of ram 34 extruding beyond the interior surface 40 of assembly 12 when ram 34 is in a fully retracted position. Radial alignment may be provided by hardware means (not shown) mounted inside mounting tube 66, having engaging means (not shown) which engage interior end 36 of ram 34 when ram 34 is in a fully retracted position.

Fluid flow into cylinder 76 is controlled by a hydraulic power pack 84 which pumps fluid into cylinder 76 through hoses 86*a* and 86*b*. Power pack 84 includes a pump, a motor, and valves for controlling the flow of fluid through hoses 86*a* and 86*b*. Pump size and motor horse power rating of power pack 84 will vary depending on the force a designer desires to be exerted by each ram and the number of rams to be driven by hydraulic power pack 84. The speed with which a ram extends into assembly 12 can be controlled by providing proportioning valves in power pack 84 which can be adjusted to open to varying degrees, and thereby can control the speed with which fluid flows into cylinder 76. Hydraulic power pack 84 is controlled by a control unit 90 which may be located at or near power pack 84 or at a remote location, possibly in a control room.

Of course, as will be recognized by those skilled in the art, a virtually endless number of different means may be employed to control the movement of a ram into and out of the chute and spout assembly in addition to the means specifically described. For example, a ram may be moved with a pneumatic cylinder, or by mechanical means. A mechanical ram-moving means may be provided by a ram that is threaded substantially throughout its length. Such a ram may be threadably received in threads formed in a mounting block welded to the exterior surface of the chute and spout assembly. A threaded ram could be moved into and out of the chute and spout assembly by means of a variable speed motor, possibly in combination with gear means, adapted to rotate the threaded ram about its axis in either direction through a threaded mounting block.

The preferred distance of a ram from cutting disc 14 will depend on the length of the log to be fed into the chipper. That is, rams are best situated at locations where imparting an upward force on a log is most likely to clear a logjam. By convention, logs are chipped by chippers in 4 foot lengths, 8 foot lengths, and 12 foot lengths. If the chipper normally chips 4 foot long logs, then a ram or rams should be installed in spout bottom 30. If the chipper chips 8 foot logs, then a ram should be installed in spout transition piece 28. If 12 foot logs are chipped, a ram should be installed in chute. This is not to say that a ram or rams installed in spout bottom 30 will not help to clear logjams longer than 4 feet, only that the preferred position for a ram is at a distance from cutting disc 14 equivalent to about 50 to 90 percent of the length of the logs to be chipped.

It will be recognized that an economic advantage is realized by installing a ram or rams in a transition piece 28. Chute 18 and spout 20, having a stationary blade 24, both typically cost more than 10 times the amount of transition piece 28. Thus, chute and spout assemblies in accordance with the invention can be made cost effectively by forming a transition piece having a ram or rams mounted thereon and then installing the ram-containing transition piece onto a chute and spout assembly.

Figure 5:
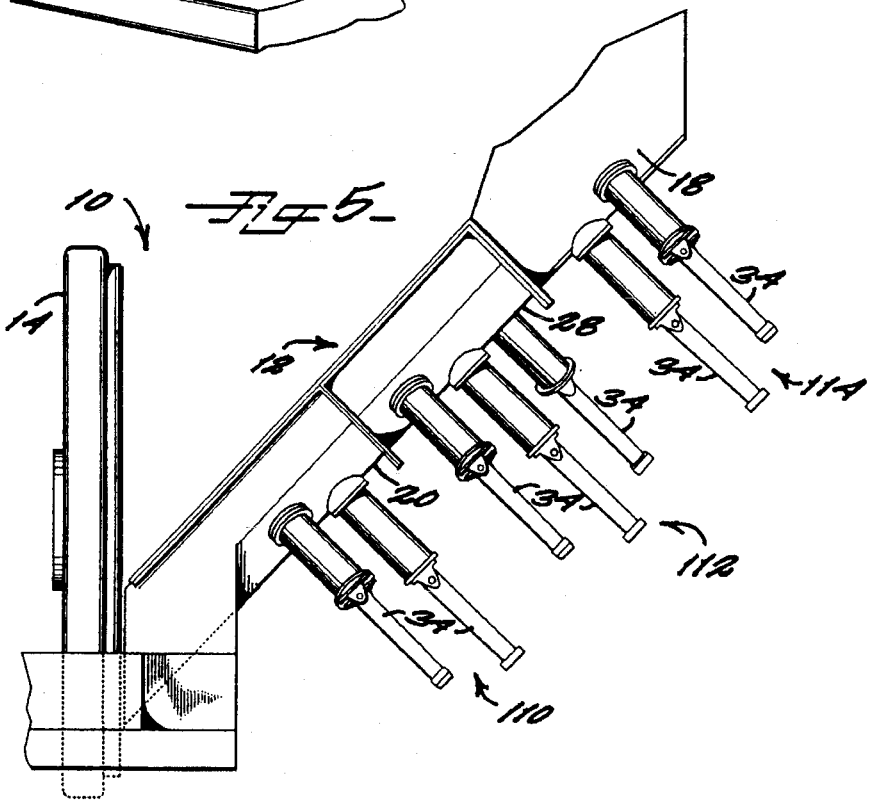
FIG. 5 is a side view of a chute and spout assembly in accordance with the invention having a plurality of pairs of rams disposed along the length of the chute and spout assembly.

FIG. 5 shows an embodiment of the invention designed to clear logjams of various lengths. As shown, chute and spout assembly 12 has disposed thereon a plurality of sets of rams at various points along the assembly. If four (4) foot logs are chipped, then first set 110 will normally be operated to clear logjams. If eight (8) foot logs are chipped, then second set 112 will normally be operated to clear logjams. Twelve (12) foot logs will normally be cleared of logjams by operating third set 114.

Figure 6:
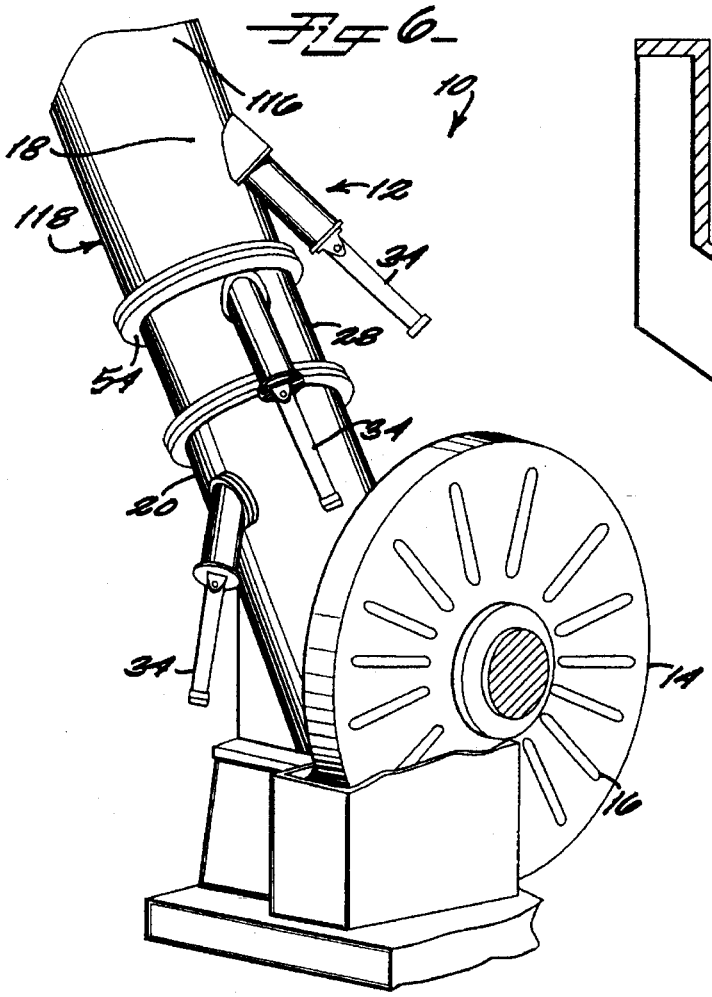
FIG. 6 is a perspective view of an embodiment of the invention having a cylindrical chute and spout assembly and obliquely-mounted rams.

It will also be recognized that the invention is not limited to use with a particular chute or spout configuration, or to a specific arrangement of rams on a chute or spout. FIG. 6 shows another possible embodiment of the invention. Chute and spout assembly 12 in this embodiment is cylindrical, and rams are disposed at various locations about the circumference of the cylinder 118, including points at or near the cylinder top 116. So that rams are optimally effective in clearing logjams, all rams are directed at least slightly upwardly with respect to the horizontal plane. It is noted that rams mounted at cylinder top 116 must be mounted at an extreme angle with respect to the cylinder 118 in order for such rams to impart an upwardly directed force. It is seen that a cylinder 118 of this particular embodiment may have a plurality of rams disposed about the circumference of the cylinder 118. These rams can operate cooperatively as in the fashion of a cooperative pair of rams described previously.

Rams of the invention can be operated manually, or may be operated by control means at remote locations in communication with rams installed in the chute or spout. Rams of the invention can also be employed in a fully automatic chipper chute and spout assembly logjam clearing system.

In an automatic logjam clearing system, sensor means are disposed throughout the chipper to sense when a jam has occurred. A jam sensor means may be based on a motion detector mounted above the chute and spout assembly 12 which senses when logs have stopped flowing, or may be based on a torque detector disposed on cutting disc 14, which is triggered when there is no load on cutting disc 14 and hence no log flow. Importantly, a jam sensor means should not be erroneously triggered when there are no logs at all in the chute or spout. Accordingly, one of the above detectors should be coupled with an additional detector, which may be based on a light detector in combination with a properly situated light source, that detects if there are, in fact, logs in the chute and spout assembly 12.

Signals from such sensor means are input into a control means, preferably provided by a microprocessor. When it is determined that a jam has occurred, then the control means directs the ram or rams to operate. A microprocessor control means can be programmed to direct a pair of rams to conduct a routine such as the one described: A first ram operates; then a second; then both simultaneously if the logjam has not yet cleared. It is expected that an operator will create new routines which are effective in clearing logjams, which may vary, for example, depending on the operator's particular chipper, the particular style of rams used, the size of logs sent into the chipper, etc. Operators can program a microprocessor to execute these new logjam clearing routines automatically upon the sensing of a jam, or by activating a control means at an operator's discretion. Logjam sensor means can also be provided by way of pressure detectors disposed along the interior walls of the chute and spout. Signals from such pressure detectors can be used to determine not only when a jam has occurred (when sustained pressure is sensed as opposed to routine bumping against walls by flowing logs), but also the location of the jam and the type of jam. Signals from the pressure detectors can be input into a microprocessor which is programmed to direct a different logjam clearing routine depending on the type and location of a logjam.

It will be clear to those skilled in the art to which the present invention pertains from a reading of the foregoing that many changes and substitutions can be made to the preferred embodiments without departing from the spirit and scope of the present invention, which is defined by the appended claims.

What is claimed is:

1. Apparatus for use with a wood chipper that chips logs, said chipper having a cutting disc, said apparatus comprising:

a chute and spout assembly positioned to guide said logs toward said cutting disc, said assembly having an exterior and an interior surface on which said logs slide toward said cutting disc;

a ram attached to said chute and spout assembly, said ram having a retracted position and an extended position, said ram extending into said interior of said assembly when in said extended position and retracted from said interior when in said retracted position, said ram being movable between said retracted and said extended position to move logs on said interior surface of said assembly so that jammed logs can be cleared; and means for moving said ram between said retracted and said extended positions.

2. The apparatus as recited in claim 1, wherein said ram is oriented so that, when in said extended position, said ram does not extend toward said cutting disc.

3. The apparatus as recited in claim 1, wherein said ram is oriented to extend approximately at right angles with respect to said chute and spout assembly.

4. The apparatus as recited in claim 1, wherein said moving means controls the speed with which said ram moves between said retracted and said extended positions.

5. The apparatus as recited in claim 1, wherein said ram has an end that is approximately flush with said interior surface when said ram is in said retracted position so that logs can slide over said end of said ram.

6. An apparatus for use with a wood chipper that chips logs, said chipper having a cutting disc, said apparatus comprising:

a chute and spout assembly having a first end and an opposing second end, said second end proximate to said cutting disc, said assembly having an interior and an interior surface on which said logs slide toward said cutting disc;

a plurality of rams carried by said assembly, each ram of said plurality of rams having an extended position and a retracted position, said each ram being extended into said interior of said assembly when in said extended position and retracted from said interior when in said retracted position, said each ram being spaced apart from each other ram so that, when said plurality of rams are in said extended positions, said each ram does not interfere with each other ram; and means for moving said plurality of rams between said retracted positions and said extended positions.

7. The apparatus as recited in claim 6, wherein said plurality of rams is two rams.

8. The apparatus as recited in claim 6, wherein said moving means moves said each ram independently of said each other ram.

9. The apparatus as recited in claim 6, wherein one ram of said plurality of rams is positioned closer to said first end of said chute than other rams of said plurality of rams.

10. The apparatus as recited in claim 6, where said each ram of said plurality of rams is positioned at approximately the same distance from said second end of said assembly.

11. The apparatus as recited in claim 6, wherein said moving means controls the speed with which said ram moves between said retracted and said extended position.

12. The apparatus as recited in claim 6, wherein said each ram is oriented so that, when in said extended position, said ram does not extend toward said cutting disc.

13. The apparatus as recited in claim 6, wherein said each ram is oriented so that it extends approximately at right angles with respect to said chute and spout assembly.

14. The apparatus as recited in claim 6, wherein said ram has an end that is approximately flush with said interior surface when said ram is in said retracted position.

15. An apparatus for use with a wood chipper that chips logs, said chipper having a cutting disc, said apparatus comprising:

a chute and spout assembly having a first end and an opposing second end, said second end proximate to said cutting disc, said assembly having an interior and an interior surface on which said logs slide toward said cutting disc, said assembly having a plurality of throughholes formed therein;

a plurality of rams carried by said chute and spout assembly, each ram of said plurality of rams having an extended position and a retracted position, said each ram being extended into said interior of said assembly through one throughhole of said plurality of throughholes when in said extended position and retracted from said interior when in said retracted position, said each ram being spaced apart from each other ram so that, when said plurality of rams are in said extended positions, said each ram does not interfere with each other ram, said each ram being oriented to extend approximately perpendicular to said assembly; and means for moving said each ram independently of said each other ram of said plurality of rams between said retracted positions and said extended positions.

16. The apparatus as recited in claim 15, where said each ram of said plurality of rams is positioned at approximately the same distance from said second end of said assembly.

17. The apparatus as recited in claim 15, wherein said moving means controls the speed with which said ram moves between said retracted and said extended position.

18. The apparatus as recited in claim 15, wherein said each ram is oriented so that, when in said extended position, said each ram does not interfere with said each other ram.

19. The apparatus as recited in claim 15, said ram comprising a ramming end and a body, said ramming end having a larger cross-sectional area than said body.

* * * * *